United States Patent [19]

Shirato et al.

[11] 4,163,364

[45] Aug. 7, 1979

[54] METHOD FOR RECOVERING ENERGY POSSESSED BY EXHAUST GAS FROM BLAST FURNACE

[75] Inventors: Takeshi Shirato; Kiyomi Teshima, both of Tamano, Japan

[73] Assignee: Mitsui Engineering & Shipbuilding Co., Ltd., Tokyo, Japan

[21] Appl. No.: 867,278

[22] Filed: Jan. 5, 1978

[30] Foreign Application Priority Data

Feb. 15, 1977 [JP] Japan ..... 52/15817

[51] Int. Cl.[2] ..... F02C 9/02

[52] U.S. Cl. ..... 60/39.02; 415/160

[58] Field of Search ..... 60/39.02, 39.25, 643, 60/645; 415/159, 160, 161, 48, 49

[56] References Cited

U.S. PATENT DOCUMENTS

| | | | |
|---|---|---|---|
| 4,069,660 | 1/1978 | Inubushi et al. | 60/39.02 |
| 4,072,006 | 2/1978 | Inubushi et al. | 60/39.02 |

*Primary Examiner*—Allen M. Ostrager

*Attorney, Agent, or Firm*—Armstrong, Nikaido, Marmelstein & Kubovcik

[57] ABSTRACT

In a method for recovering energy of an exhaust gas from a blast furnace as electric energy by introducing the total flow rate of the exhaust gas into a turbine, the efficiency of recovery of the power energy is enhanced by controlling the attachment angle of stationary blades of the turbine so that the furnace top pressure might be maintained at a predetermined level.

7 Claims, 9 Drawing Figures

METHOD FOR RECOVERING ENERGY POSSESSED BY EXHAUST GAS FROM BLAST FURNACE

BACKGROUND OF THE INVENTION

The present invention relates to a method for enhancing the efficiency of recovering energy possessed by an exhaust gas from a blast furnace.

A large quantity of exhaust gas is discharged from a blast furnace. Since this exhaust gas has large quantities of thermal and kinetic energies, if the gas is discharged into open air as it is, large quantities of energies are wastefully lost.

Accordingly, there have heretofore been made various attempts to recover a part of such energies while converting it to electric energy. A typical instance of these conventional attempts will now be described by reference to FIG. 1 of the accompanying drawings. An exhaust gas discharged from a blast furnace 1 is introduced through a duct 2 into a dust precipitating system including a dust collector 3, a duct 4 and a venturi scrubber 5 and it is then introduced into a turbine 7 through a duct assembly 6 (which comprises ducts **6*a* and 6*b* as later to be described). In the turbine 7, the energy possessed by the exhaust gas is converted to an energy for rotating a turbine shaft 8, and by this energy, a generator 9 is rotated. Thus, the majority of the energy of the exhaust gas discharged from the blast furnace 1 is recovered in the form of an electric energy. The exhaust gas discharged from the turbine 7 is transferred through a duct assembly 10 (which comprises ducts 10*a* and 10*b***) and it is then passed through a second venturi scrubber (not shown) according to need. Then, the exhaust gas is discharged into a low pressure gas line where the pressure is maintained at a level approximating to the atmospheric pressure.

In practising this method, however, problems are encountered since the pressure or flow rate of the exhaust gas is not always kept constant, and it is desired to make improvements for solving these problems. These problems will now be described one by one.

The flow rate of the exhaust gas is frequently changed mainly by opening or closing of a bell for feeding intermittently a raw material to the top of the blast furnace or by charging of the low-temperature raw material. In order to eliminate this disadvantage, the following arrangement is usually made in the energy recovery method shown in FIG. 1.

More specifically, the duct assembly 6 is connected to the duct assembly 10 through a duct 11, and a septum valve 12 is disposed in the midway of the duct 11 and a throttle valve 14 is disposed in the midway of the duct **6*b* of the duct assembly 6 extending on the side of the turbine 7 from a junction point 13 of the duct 11 (accordingly, the duct extending from the venturi scrubber 5 to the junction point 13 is the duct 6*a*). Further, a throttle valve 16 is attached to the duct 10*a* extending from a connecting point 15 of the duct assembly 10 and the duct 11 on the side of the turbine 7 (accordingly, the duct extending downstreams from the connecting point 15 is the duct 10*b*). The degree of opening in the septum valve 12 is adjusted according to the pressure detected by an oscillator 17 for detecting the furnace top pressure, and 70 to 90% of the total flow of the exhaust gas is introduced into the duct 6*b* leading to the turbine and the remainder, namely 30 to 10%, of the total flow of the exhaust gas is flown into the duct 11 in which the septum valve 12** is disposed. Namely, the basic portion of the exhaust gas that is not influenced even by variations of the flow rate of the exhaust gas is flown into the turbine, and the remainder of the exhaust gas exceeding the above basic portion that is increased or decreased by variations of the flow rate is flown into the septum valve, so that the furnace top pressure might be maintained at a predetermined level by the septum valve. According to this method, however, no power energy is recovered from the exhaust gas passed through the septum valve. As means for overcoming this disadvantage and improving the energy recovery efficiency, there has been proposed a method in which a turbine having a capacity such that the maximum quantity of the exhaust gas dischargeable when the turbine is operated in the normal state can be flown into the turbine is used, the total flow of the exhaust gas is ordinarily flown into the turbine and only when a "blow-off" phenomenon is caused in the blast furnace or the turbine must be stopped for some reason or the other, the septum valve is operated.

This method, however, also involves a problem to be solved. More specifically, even when the quantity of the gas generated in the blast furnace is reduced to a level lower than the quantity of the gas generated at the normal operation state or when the blast furnace is operated while maintaining the operation efficiency especially at a low level, controls should be made so that the furnace top pressure might be maintained at a predetermined level.

In order to solve this problem, there is ordinarily adopted a method in which a governor valve 18 is mounted on the duct **6*b* as shown in FIG. 2 and the degree of opening of the governor valve 18 is adjusted according to the pressure detected by the oscillator 17 for detecting the furnace top pressure so that the furnace top pressure might be maintained at a predetermined level or higher. In practising this method, when the furnace top pressure is lower than the predetermined level even if the total flow of the exhaust gas is introduced into the duct 6*b*, the governor valve disposed in the duct 6*b*** should be further throttled so that the furnace top pressure might be restored to the predetermined level or higher. According to this method using the governor valve, the loss by throttling of the governor valve is inevitably caused: The quantity of the recovered energy becomes reduced by the throttle loss. This reduction of the recovered energy is especially serious when the operation efficiency must be maintained at a low level over a long period. More specifically, at the low-efficiency operation, the amount of the exhaust gas discharged is reduced, and even in such case, the gas flow must be considerably throttled by the governor valve so as to maintain the predetermined furnace top pressure. Accordingly, the throttle loss cannot be neglected. Therefore, it is eagerly desired to establish an energy recovery method in which the loss of energy by the use of the governor valve can be remarkably reduced.

OBJECTS OF THE INVENTION

It is therefore a primary object of the present invention to provide a method for recovering energy of an exhaust gas from a blast furnace while introducing the total flow of the exhaust gas into a turbine, in which the loss of energy by throttling of the gas flow by a throttle valve disposed in the midway of a duct for introducing the exhaust gas into the turbine can be effectively reduced and the power recovery efficiency can be enhanced.

Another object of the present invention is to establish an energy recovery method in which energy possessed by an exhaust gas from a blast furnace can be effectively converted to electric energy and be recovered in the form of an electric energy while controlling the furnace top pressure.

BRIEF SUMMARY OF THE INVENTION

In accordance with the present invention, the foregoing objects can be attained by a method for recovering energy from an exhaust gas from a blast furnace which comprises introducing the exhaust gas from the blast furnace into a turbine, converting a part of the energy possessed by the exhaust gas into an energy for rotating the shaft of the turbine and recovering the energy in the form of an electric energy, wherein an axial flow turbine is used as the turbine and the attachment angle of stationary blades of said turbine is changed according to variations of the quantity of the generated blast furnace gas so as to control the furnace top pressure at a predetermined level.

DETAILED DESCRIPTION OF PREFERRED EMBODIMENTS

Figure 1:
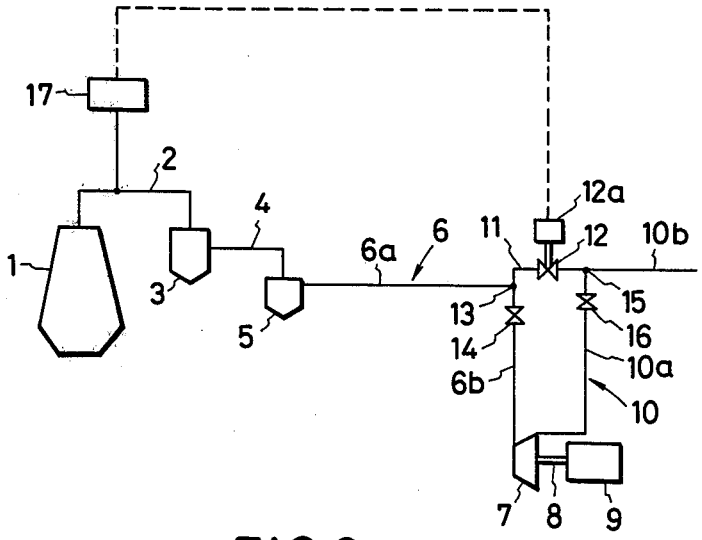
FIGS. 1 and 2 are flow charts, illustrating the conventional methods.
Figure 2:
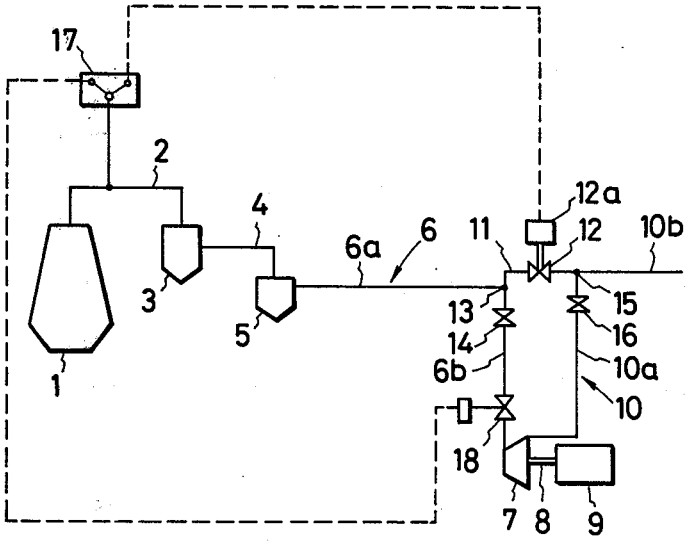
Figure 3:
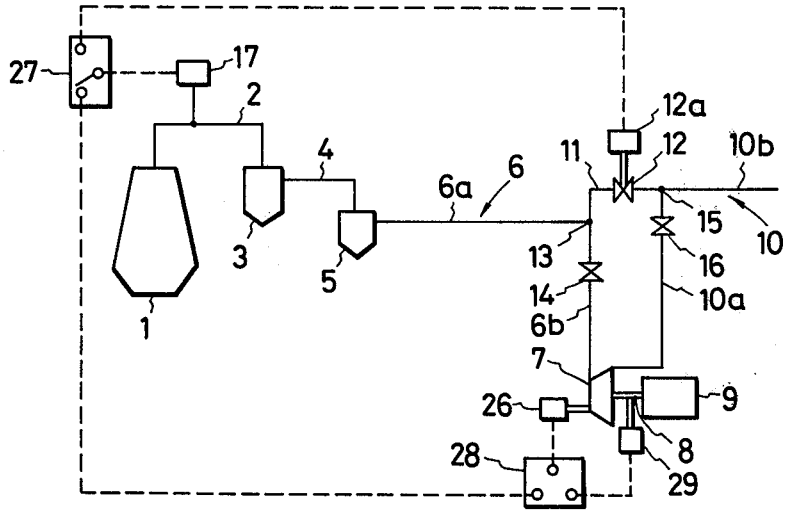
FIG. 3 is a flow chart, illustrating one embodiment of the method of the present invention.

One typical embodiment of the method of the present invention is illustrated in the flow chart of FIG. 3. The method of the present invention is in agreement with the conventional methods shown in FIGS. 1 and 2 in the point that an exhaust gas discharged from a blast furnace 1 is introduced into a turbine 7 through a duct 2, a dust collector 3, a duct 4, a venturi scrubber 5 and ducts 6*a* and 6*b* (a series of the above-mentioned ducts will sometimes be referred to as "introduction duct" in what follows). Further, the method of the present invention is in agreement with the conventional methods shown in FIGS. 1 and 2 in the following three (3) points: The exhaust gas introduced into the turbine 7 is discharged through ducts 10*a* and 10*b* (which will sometimes be referred to as "discharge duct" herein), the duct assembly 6 is connected to the duct assembly 10 through a duct 11 having a septum valve 12 (this duct will herein sometimes be referred to as "bypass duct"), and the rotation of the turbine 7 is transmitted to a generator 9 through a rotation shaft 8 of the turbine 7.

However, the method of the present invention is different and characteristic over the conventional methods in the following points: An axial flow turbine having rotary blades and stationary blades is used as the turbine, the attachment angle of the stationary blades is variable, and the attachment angle of the stationary blades is changed according to the top pressure of the blast furnace.

Figure 4:
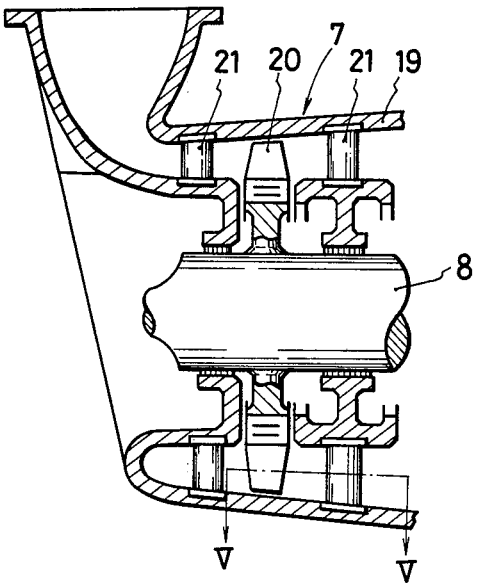
FIG. 4 is a partial view illustrating the longitudinal section of an axial flow turbine having rotary blades and stationary blades which is used for practising the method of the present invention.
Figure 5:
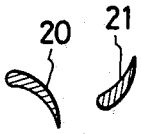
FIG. 5 is a view showing the section taken along line V—V in FIG. 4.
Figure 6:
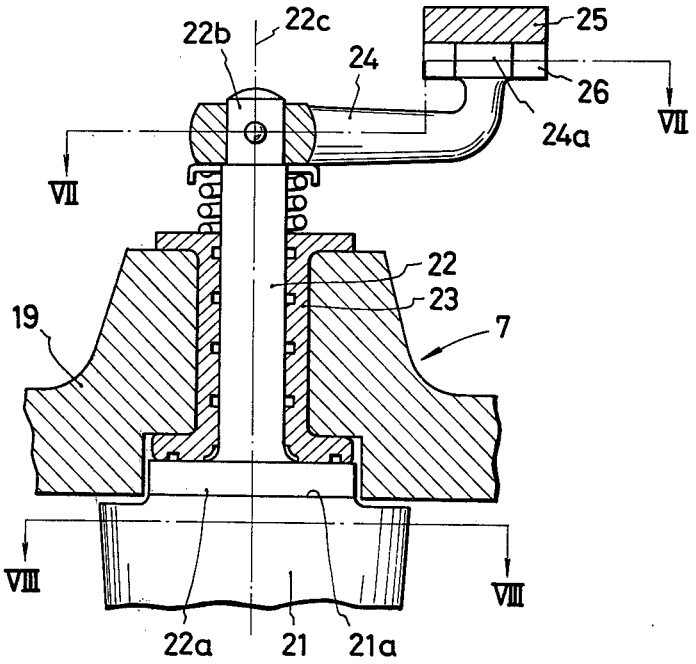
FIG. 6 is a view showing the longitudinal section of a mechanism for changing the attachment angle of stationary blades.
Figure 7:
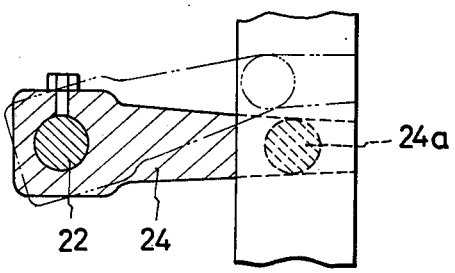
FIG. 7 is a view showing the section taken along line VII—VII in FIG. 6.
Figure 8:
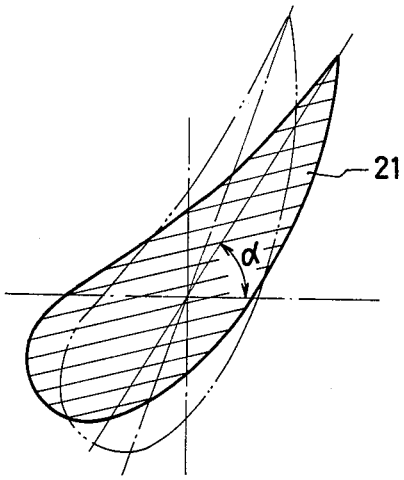
FIG. 8 is a view showing the section taken along line VIII—VIII in FIG. 6.

A typical instance of the axial flow turbine 7 that is used in the present invention is illustrated in a partial view of FIG. 4 showing the longitudinal section of the axial flow turbine 7. Referring to FIG. 4, a turbine shaft 8 is rotatably supported at the center of a casing 19 of the turbine 7 and rotary blades 20 are attached to the turbine shaft 8. Stationary blades 21 are attached to the casing 19 at points adjacent to the rotary blades 20 with respect to the acial direction of the turbine shaft 8. The sections of the rotary blades 20 and stationary blades 21 are shown in FIG. 5 illustrating the section taken along the line V—V in FIG. 4. In the turbine 7 that is used for practising the method of the present invention, the attachment angle of the stationary blades 21 can be changed. In FIG. 4, the stationary blades 21 is drawn so as to clarify the feature that the attachment angle thereof is variable. An instance of the mechanism for changing the attachment angle of the stationary blades 21 is illustrated in FIG. 6. Referring to FIG. 6, the lower end 22*a* of a holding shaft 22 for the stationary blades 21 is fixed to the top end 21*a* of the stationary blades 21 attached to the casing 19, and the shaft 22 is supported by a bearing 23 attached to the casing 19. An arm 24 for adjusting the attachment angle of the stationary blades 21 is fixed to the top end 22*b* of the holding shaft 22 that is located on the opposite side of the above-mentioned lower end 22*a*, and when the top end 24*a* of the arm 24 is turned with the rotation center 22*c* of the holding shaft 22 being as the center of turning with movement of an annular member 25, the holding shaft 22 is rotated and the attachment angle of the stationary blades 21 is changed. This adjustment of the attachment angle of the stationary blades 21 is illustrated in FIGS. 7 and 8. Namely, FIG. 7 is a view showing the section taken along line VII—VII in FIG. 6 and illustrating the state where the holding shaft 22 is rotated by moving the top end 24*a* of the arm 24, and FIG. 8 is a view showing the section taken along line VIII—VIII in FIG. 6 and illustrating the state where the attachment angle $\alpha$ of the stationary blades 21 is changed by rotation of the holding shaft 22.

An engaging groove 26 is formed on the inner side of the annular member 25 disposed around the casing 19 so that when the annular member 25 is rotated within a certain range, the top end 24*a* of the arm 24 fitted in said groove 26 is moved with said rotation of the annular member 25. The numbers of the above-mentioned holding shafts and arms attached to the casing 19 for changing the attachment angle of the stationary blades 21 are determined depending on the number of the stationary blades 21 to be attached. Further, the number of the engaging grooves 26 formed on the inner side of one annular member 25 is equal to the stationary blades 21, and the top ends of the arms are fitted in the corresponding grooves 26, respectively. A mechanism for rotating the annular member 25 according to the detected furnace top pressure and a mechanism for adjusting the attachment angle of the stationary blades according to the furnace top pressure are inclusively represented by reference numeral 26 in FIG. 3. The structures of these mechanisms are well known in the art.

Two signal changeover devices 27 and 28 are disposed between the oscillator 17 and the stationary blades attachment angle adjusting mechanism 26. The former device 27 may be arranged so as to send a furnace pressure signal to an operation mechanism 12*a* for the septum valve 21. The device 27 is used mainly when the blast furnace is operated under a normal furnace pressure. The latter device 28 is capable of transmitting to the stationary blades attachment angle adjusting mechanism a signal of a governor signal emitting oscillator 29 for detecting the rotation speed of the rotation shaft 8 of the turbine 7.

The above-mentioned system is operated in the following manner:

While the turbine 7 is stopped, a cut-off valve 14 is in the state cutting off the gas flow, and the total flow of the exhaust gas is passed through the septum valve 12 and the septum valve 12 is actuated to maintain the furnace top pressure at a predetermined level in response to a signal from the furnace top pressure controlling oscillator 17. When the turbine 7 is started, the cut-off valve 14 is closed and the governor signal emitting oscillator 29 is connected to the stationary blades attachment angle adjusting mechanism 26.

Then, a cut-off valve 16 is wholly opened, the speed is set at a point of zero in the governor valve signal emitting oscillator 29, and the stationary blades 21 are set in the wholly closed state. At this point, the cut-off valve 14 is gradually opened to enhance the rotation speed of the turbine 7. When the cut-off valve 14 is wholly opened, the level of the governor signal is gradually elevated and synchronization is effected by controlling the stationary blades. Thus, the turbine 7 is kept in the governor-free state.

Subsequently, the connection of the stationary blades attachment angle adjusting mechanism 26 is changed over to the furnace top pressure signal emitting oscillator 17 to the governor signal emitting oscillator 29. When the septum valve 12 is manually throttled gradually, the gas flow is shifted from the septum valve 12 to the turbine 7, and at the point when the septum valve 12 is completely cut off, the total flow of the exhaust gas is introduced into the turbine 7 and the normal operation state is established in the turbine 7. In this state, the total quantity of the gas generated in the blast furnace 1 by the normal operation is received by the turbine 7 and the energy of the received gas is recovered in the form of an electric energy.

As will be apparent from the foregoing illustration, according to the present invention, while the blast furnace 1 is operated at a low operation efficiency and the quantity of the exhaust gas is reduced, the stationary blades are kept throttled by the furnace top pressure control signal emitting oscillator 17 so as to maintain the furnace top pressure at the predetermined level. However, even in this state, the loss of energy by throttling of the stationary blades is substantially zero and in this point, the present invention is distinguishable over the method using the governor valve where the loss of energy by throttling of the governor valve is very large. Accordingly, in the present invention, the energy recovery efficiency can be remarkably enhanced. This is the most prominent feature of the present invention.

The normal operation state can be attained according to procedures different from those adopted in the above-mentioned typical embodiment of the present invention. More specifically, in the present invention, the normal operation state may be attained by disposing a governor valve in the duct 6*b* and transmitting a signal of the governor signal emitting oscillator to a mechanism for operating the governor valve. This embodiment will now be described by reference to FIG. 9.

Figure 9:
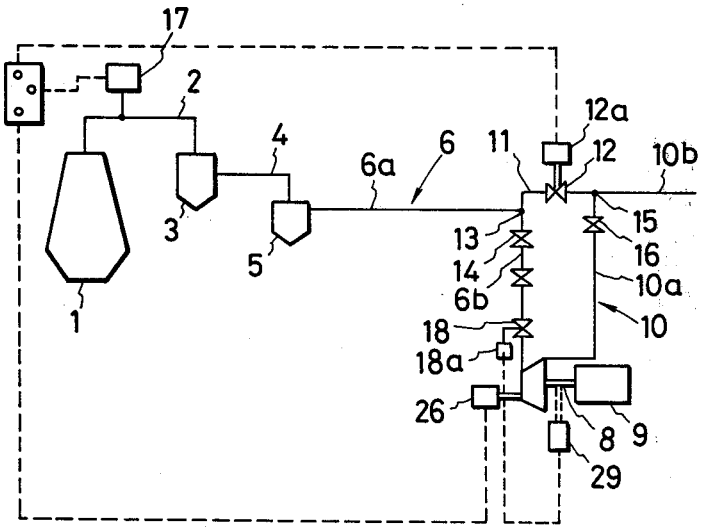
FIG. 9 is a flow chart illustrating another embodiment of the method of the present invention.

In FIG. 9, the governor valve is represented by reference numeral 18 and the mechanism for operating the governor valve 18 is represented by reference numeral 18*a*. In the embodiment shown in FIG. 9, the changeover device 28 shown in FIG. 3 is not disposed. At the point of starting the turbine 7, the valves 14 and 16 are caused to stand by for the starting as in the embodiment shown in FIG. 3, and the degree of opening of the stationary blades is set at such a low level as will allow passage of the turbine starting gas alone. Then, as in the foregoing typical embodiment, the governor valve 18 is operated and controlled by the governor signal emitting oscillator 29 to effect synchronization and attain the governor-free state in the turbine 7. In this state, the governor valve 18 is wholly opened and the furnace top pressure signal emitting oscillator 17 is changed over to the stationary blades attachment angle adjusting mechanism 26. Then, as in the embodiment shown in FIG. 3, the gas flow is shifted from the septum valve 12 to the turbine 7. Also by adopting the foregoing starting procedures, the method of the present invention can be worked effectively and conveniently. In each of the foregoing two embodiments, conventional means may be adopted to cope with such phenomenon as blow-off in the blast furnace and the turbine trip.

In case of a multi-staged turbine, stationary blades of a specific stage are connected to the stationary blades attachment angle adjusting mechanism and stationary blades of other stages are set and fixed at an attachment angle optimum for coping with variations of the flow rate of the exhaust gas with the lapse of time. By adoption of this arrangement, the intended adjustment of the attachment angle of the stationary blades can be accomplished very easily without substantial reduction of the operation efficiency of the turbine.

What is claimed is:

1. A method for recovering energy possessed by exhaust gas from a blast furnace which comprises introducing the exhaust gas from the blast furnace into a turbine, converting a part of the energy possessed by the exhaust gas to an energy for rotating the rotation shaft of the turbine and recovering the energy in the form of an electric energy, wherein an axial flow turbine is used as the turbine and the attachment angle of stationary blades of said turbine is changed according to variations of the furnace top pressure of the blast furnace so as to control the furnace top pressure at a predetermined level.

2. An energy recovery method according to claim 1, wherein the furnace top pressure is controlled in the state where the total flow of the exhaust gas from the blast furnace is introduced into the turbine.

3. A method for recovering energy from an exhaust gas from a blast furnace which comprises introducing the exhaust gas from the blast furnace into a turbine, converting the energy possessed by the exhaust gas to an energy for rotating the rotation shaft of the turbine and recovering the energy in the form of an electric energy, wherein in an exhaust gas discharge system including a bypass duct having a septum valve in the midway thereof, said bypass duct connecting the midway of an introduction duct for introducing the exhaust gas from the blast furnace to the turbine with the midway of a discharge duct for discharging the exhaust gas coming from the turbine, the exhaust gas is first introduced to said introduction duct to rotate the turbine, the rotation speed of the turbine is gradually elevated, and after the rotation speed of the turbine has been elevated to a predetermined level, attachment angle of stationary blades of the turbine is changed according to the furnace top pressure of the blast furnace.

4. An energy recovery method according to claim 3, wherein elevation of the rotation speed of the turbine is performed by controlling the stationary blades by a stationary blades attachment angle adjusting mechanism while detecting the rotation speed of the rotation shaft of the turbine or the rotation speed of the rotation shaft of a generator connected to said turbine.

5. An energy recovery method according to claim 3, wherein elevation of the rotation speed of the turbine is performed by controlling the degree of opening of a governor valve disposed in the midway of said introduction duct while detecting the rotation speed of the rotation shaft of the turbine or the rotation speed of the rotation shaft of a generator connected to said turbine.

6. An energy recovery method according to claim 4, wherein elevation of the rotation speed of the turbine is performed in the state where the septum valve is partially opened.

7. An energy recovery method according to claim 5, wherein elevation of the rotation speed of the turbine is performed in the state where the septum valve is partially opened.

* * * * *